US009910399B2

(12) United States Patent
Ida

(10) Patent No.: US 9,910,399 B2
(45) Date of Patent: Mar. 6, 2018

(54) IMAGE FORMING APPARATUS AND IMAGE FORMING METHOD FOR FORMING OVERLAPPING VISIBLE AND NON-VISIBLE IMAGES

(71) Applicant: Oki Data Corporation, Tokyo (JP)

(72) Inventor: Koji Ida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 148 days.

(21) Appl. No.: 14/717,423

(22) Filed: May 20, 2015

(65) Prior Publication Data

US 2015/0338759 A1 Nov. 26, 2015

(30) Foreign Application Priority Data

May 26, 2014 (JP) ..... 2014-107942

(51) Int. Cl.
*G03G 15/01* (2006.01)
*G03G 21/04* (2006.01)
*G03G 15/00* (2006.01)

(52) U.S. Cl.
CPC ..... *G03G 21/04* (2013.01); *G03G 15/6585* (2013.01)

(58) Field of Classification Search
CPC ..... G03G 21/04; G03G 15/6585; B41F 11/02; B41M 3/14; C23C 14/54; C23C 16/52; B42D 25/30; B42D 15/085
USPC ..... 399/40; 427/7, 8; 283/72; 430/10
See application file for complete search history.

(56) References Cited

U.S. PATENT DOCUMENTS

2011/0182607 A1* 7/2011 Takemura ..... G03G 15/0194 399/67
2012/0063819 A1* 3/2012 Kasai ..... G03G 15/6585 399/298
2012/0237868 A1* 9/2012 Yamada ..... G03G 9/0821 430/108.21
2013/0294801 A1* 11/2013 Tyagi ..... G03G 15/0126 399/223

FOREIGN PATENT DOCUMENTS

JP 2002-082582 A 3/2002

* cited by examiner

*Primary Examiner* — Walter L Lindsay, Jr.
*Assistant Examiner* — Ruth Labombard
(74) *Attorney, Agent, or Firm* — Panitch Schwarze Belisario & Nadel LLP

(57) ABSTRACT

An image forming apparatus according to the invention includes a plurality of image forming units and a changeover unit. The plurality of image forming units form multicolor images on an image carrier by overlapping, on a medium, developer images developed using developers. The changeover unit changes a layer overlapping sequence of the developer images on the medium. The developers include a developer emitting light according to radiation of non-visible light, and the changeover unit changes the layer overlapping sequence of the developer images using the developer emitting the light according to radiation of the non-visible light.

23 Claims, 3 Drawing Sheets

IMAGE FORMING APPARATUS AND IMAGE FORMING METHOD FOR FORMING OVERLAPPING VISIBLE AND NON-VISIBLE IMAGES

CROSS REFERENCE TO RELATED APPLICATIONS

This application claims priority benefits under 35 USC, section 119 on the basis of Japanese Patent Application No. 2014-107942, the disclosure of which is incorporated herein by reference.

BACKGROUND OF THE INVENTION

1. Field of the Invention

This invention relates to an image forming apparatus and an image forming method of electrophotographic method.

2. Background of Related Art

An art for prohibiting unauthorized copying and for preventing negotiable instruments from counterfeited has been known, in which a toner image made of identification information is printed on a recording medium as a material to be printed, in use of a toner including a fluorescent agent not visible under visible light but emitting light where an ultraviolet ray is radiated (see, e.g., Japanese Patent Application Publication No. 2002-82582 (A1)).

With such an image forming apparatus, non-visibility is made high by adjusting the gloss of the toner and the gloss of the transfer paper as the recording medium to be coincided to each other.

With such a prior art, however, there is a demand to make the non-visibility of the toner or toner images higher, and on the other hand, there is a contradicting demand to make the toner further glossier. It is, however, not easy to bring satisfaction to both of the demands.

SUMMARY OF THE INVENTION

In consideration for solving the above problem, it, therefore, is an object of the invention to provide an image forming apparatus and an image forming method making comparable both of image representations, namely, an image representation making necessary toner image portions glossy, and an image representation making unnoticeable a back side of a printing surface under visible light and making visible the back side under non-visible light where visible light is weak.

To solve the above problem, an image forming apparatus according to the invention comprises a plurality of image forming units forming multicolor images on an image carrier by overlapping, on a medium, developer images developed using developers, and a changeover unit changing a layer overlapping sequence of the developer images on the medium. The developers include a developer emitting light according to radiation of non-visible light, and the changeover unit changes the layer overlapping sequence of the developer images using the developer emitting the light according to radiation of the non-visible light.

These and other objects, features, aspects and advantages of this invention will become apparent to those skilled in the art from the following detailed description, which, taken in conjunction with the annexed drawings, discloses a preferred embodiment of this invention.

BRIEF DESCRIPTION OF THE DRAWINGS

Referring now to the attached drawings which form a part of this original disclosure.

DETAILED DESCRIPTION OF EMBODIMENTS

Selected embodiments of this invention will now be explained with reference to the drawings. It will be apparent to those skilled in the art from this disclosure that the following descriptions of the embodiments of the invention are provided for illustration only and not for the purpose of limiting the invention as defined by the appended claims and their equivalents.

First Embodiment

Figure 1:
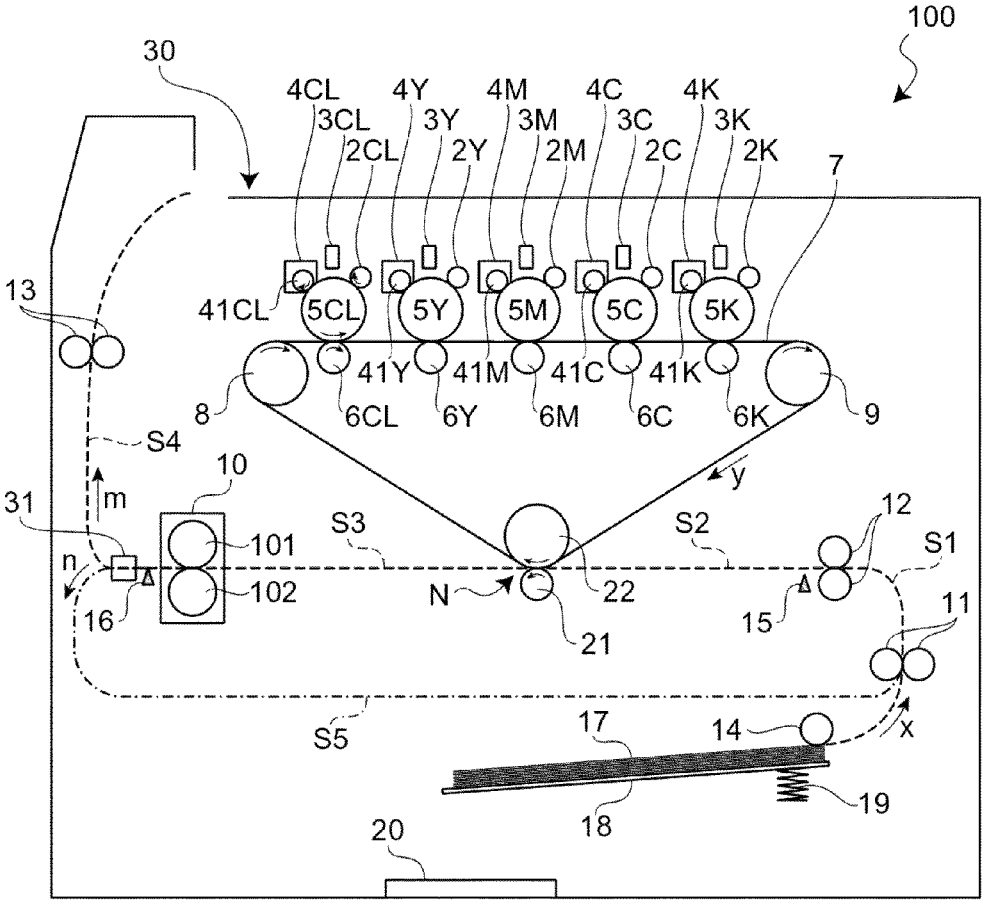
FIG. 1 is a schematic view of an essential structure of a printer as an image forming apparatus according to a first embodiment of the invention.

FIG. 1 is a schematic view of an essential structure of a printer 100 as an image forming apparatus according to a first embodiment. The printer 100 is an image forming apparatus forming multicolor images by printing in a manner sequentially overlapping toner images developed with developers of five colors, clear (transparent) toner (CL), yellow toner (Y), magenta toner (M), cyan toner (C), and black toner (K). In this embodiment, the printer 100 is described as an image forming apparatus of an intermediate transfer method in which, after toner images based on page data contained in printing codes transmitted from an external terminal not illustrated are primarily transferred onto a transfer belt 7, the toner images on the transfer belt 7 are secondarily transferred onto a recording medium 17.

As shown in FIG. 1, the printer 100 includes a medium conveyance route having a support plate member 18 loading the recording medium 17, media having no images formed thereon, as a starting point, via a route S1, a route S2, a route S3, (a route S5), and a route S4, and having a stacker 30 stacking the recording medium 17 delivered to the exterior of the apparatus body after images are formed as an end point. The support plate member 18 is a plate member capable of loading the recording medium 17 used for image formation, and is used in a direction pushing the recording medium 17 toward a hopping roller 14 by a spring 19. The hopping roller 14 rotates according to drive of the drive motor not illustrated in a state contacting with the recording medium 17, and feeds the recording medium 17 separately sheet by sheet in arrow-x direction in FIG. 1.

A first conveyance roller 11 is provided on the route S1. The first conveyance roller 11 rotates according to drive of the drive motor not illustrated, and conveys the recording medium 17 fed by the hopping roller 14 to a second conveyance roller 12. The second conveyance roller 12 is provided between the route S1 and the route S2, which guides the recording medium 17 to a nipping portion N serving as the secondary transfer position, removes skewing of the recording medium 17 by hitting treatment of the recording medium 17, and conveys the recording medium 17 to the nipping portion N upon rotating according to drive of the drive motor not illustrated. A writing sensor 15 is provided on a downstream side of the second conveyance roller 12 on the route S2. The writing sensor 15 is an optical or mechanical sensor detecting passage of the recording medium 17. Detection results of the writing sensor 15 are outputted to a printing controller 20, and are used for measuring timings of the secondary transfer of the toner images at the nipping portion N.

The recording medium 17 to which the toner image is secondarily transferred at the nipping portion N is further conveyed to a fixing device 10 provided at the end point of the route S3. The fixing unit 10 includes a heating roller 101 maintained at a prescribed fixing temperature and a backup roller 102 provided in pressure contact with the heating roller 101. On the recording medium 17 with the transferred toner image, the toner receives heat and pressure at the nipping portion N by passing between the heating roller 101 and the backup roller 102, so that the toner is melt and that the toner image is fixed. The heating roller 101 is formed by, for instance, covering a heat resisting elastic layer of a silicone rubber on a hollow cylindrical core metal made of, e.g., aluminum, and covering a tube of PFA (polytetrafluoroethylene-perfluoroalkyl vinyl ether copolymer) thereon. A heating device, e.g. a halogen lamp is mounted inside the core metal, and maintains the prescribed fixing temperature by controlling turning on and off of the heating device based on the surface temperature of the roller detected by a temperature detecting means not illustrated. The backup roller 102 is formed by, for instance, covering a heat resisting elastic layer of a silicone rubber on a hollow cylindrical core metal made of, e.g., aluminum, and further covering a PFA tube thereon.

A delivery sensor 16 is provided on a downstream side of the fixing device 10 on the conveyance route. The delivery sensor 16 is an optical or mechanical sensor detecting passage of the recording medium 17. Detection results of the delivery sensor 16 are outputted to the printing controller 20 described below, and are used for measuring timings of switching the medium conveyance routes at a conveyance route switching portion 31. The conveyance route switching portion 31 switches the conveyance route of the recording medium 17 passing through the fixing device 10 to either of the route S4 shown with arrow-m direction in FIG. 1 and the route S5 shown with arrow-n in FIG. 1 based on the instruction from the printing controller 20 as described below.

For example, where the conveyance route of the recording medium 17 is switched to the route S4 according to the conveyance route switching portion 31, the recording medium 17 is delivered out of the apparatus body according to rotation of the delivery roller 13 provided on the route S4, and stacked on the stacker 30. To the contrary, where the conveyance router of the recording medium 17 is switched to the route S5 according to the conveyance route switching portion 31, the recording medium 17 is conveyed via the route S5 in a state that a side of the transfer surface of the toner image is down. The recording medium 17 is conveyed again to the nipping portion N in a manner that the transfer side of the toner image is up as conveyed to the first conveyance roller 11, the route S1, and the second conveyance roller 12, and is subject to transfer of the toner image of the second time. The recording medium 17 that finished the transfer of the toner image of the second time is delivered to the exterior of the apparatus body according to rotation of the delivery roller 13 upon conveyed through the route S3, the fixing device 10, and the route S4, and is stacked on the stacker 30.

With the image forming apparatus of an intermediate method such as the printer 100 according to this embodiment, the toner images transferred to the recording medium 17 at the nipping portion N as the secondary transfer position are conveyed to the nipping portion N after primarily transferred to the transfer belt 7. The nipping portion N is formed by contacting a secondary transfer roller 21 with pressure to a secondary transfer backup roller 22 via the transfer belt 7, and makes the toner images on the transfer belt 7 secondarily transferred to the recording medium 17 by application of a transfer voltage having the opposite polarity to the charge potential of the toner from a high voltage power supply not illustrated to the secondary transfer roller 21.

The transfer belt 7 is an endless belt member tensioned by the secondary transfer backup roller 22 described above, a drive roller 8, and an idle roller 9. The drive roller 8 rotates in an arrow direction in FIG. 1 according to drive of the drive motor not illustrated. The idle roller 9 is driven to rotate in an arrow direction in FIG. 1 according to rotation of the drive roller 8, thereby driving the transfer belt 7 in the arrow Y direction in FIG. 1.

Photosensitive drums 5CL, 5Y, 5M, 5C, 5K (hereinafter, occasionally referred to as simply photosensitive drum 5) serving as image carriers for carrying the toner images are arranged at the transfer belt 7 tensioned by the drive roller 8 and the idle roller 9 in a manner contacting primary transfer rollers 6CL, 6Y, 6M, 6C, 6K (hereinafter, occasionally referred to as simply transfer rollers 6) with pressure via the transfer belt 7.

Near the photosensitive drums 5CL, 5Y, 5M, 5C, 5K, charge rollers 2CL, 2Y, 2M, 2C, 2K (hereinafter, occasionally referred to as simply charge roller 2), and exposure devices 3CL, 3Y, 3M, 3C, 3K (hereinafter, occasionally referred as to simply exposure device 3), developing devices 4CL, 4Y, 4M, 4C, 4K (hereinafter, occasionally referred to as simply developing device 4) having developing rollers 41CL, 41Y, 41M, 41C, 41K (hereinafter, occasionally referred to as developing rollers 41) are disposed from an upstream side in the rotation direction.

Photosensitive drums 5CL, 5Y, 5M, 5C, 5K are organic photosensitive bodies respectively structured with a conductive supporter and a photo-conducting layer, e.g., structured with a metal shaft, e.g. aluminum as the conductive supporter sequentially overlapped with a charge generation layer and a charge transfer layer as the photo-conducting layer.

The charge rollers 2CL, 2Y, 2M, 2C, 2K are structured respectively with a metal shaft, e.g. stainless steel and a semiconductive epichlorohydrin rubber, and are disposed in contact with the respective periphery of the photosensitive drums 5CL, 5Y, 5M, 5C, 5K. The charge rollers 2CL, 2Y, 2M, 2C, 2K are coupled to a high voltage power supply not illustrated, and are driven by rotation of the photosensitive drums 5CL, 5Y, 5M, 5C, 5K to rotate and make the respective surfaces of the photosensitive drums 5CL, 5Y, 5M, 5C, 5K charge at, e.g., −600 Volts respectively.

The exposure devices 3CL, 3Y, 3M, 3C, 3K are formed of an LED head having, e.g., a light emitting element such as an LED (Light Emitting Diode) device and a lens array. The exposure devices 3CL, 3Y, 3M, 3C, 3K form electrostatic latent images upon light attenuation to about −50 Volts by radiating light to the surfaces of the photosensitive drums 5CL, 5Y, 5M, 5C, 5K based on the page data contained in the printing commands.

The developing rollers 41CL, 41Y, 41M, 41C, 41K are formed by, e.g., covering a semiconductive silicone rubber dispersed with carbon black on an outer periphery of a core metal of a metal shaft made of, e.g., stainless steel, and make developments of the electrostatic latent images formed on the surfaces of the photosensitive drums 5CL, 5Y, 5M, 5C, 5K with negatively charged toner as developers. The developing rollers 41CL, 41Y, 41M, 41C, 41K are contained in the developing devices 4CL, 4Y, 4M, 4C, 4K together with supply rollers not illustrated for supplying toner to the developing rollers 41CL, 41Y, 41M, 41C, 41K, and developing blades not illustrated limiting the layer thickness of the toner layers on the surfaces of the developing rollers 41CL, 41Y, 41M, 41C, 41K.

The photosensitive drum 5, the charge roller 2, and developing device 4, etc. as image forming means are structured as image forming units detachably attaching to the printer 100. The toner of the respective colors are contained in toner cartridges not illustrated structured as to be detachably attached to the image forming units, and are supplied to the developing device 4.

The primary transfer rollers 6CL, 6Y, 6M, 6C, 6K provided as to contact the photosensitive drums 5CL, 5Y, 5M, 5C, 5K with pressure via the transfer belt 7 are coupled to a high voltage power supply not illustrated, and the toner images developed on the surfaces of the respective photosensitive drums 5CL, 5Y, 5M, 5C, 5K are primarily transferred to the transfer belt 7 by the applied transfer voltage.

Controls of the printer 100 according to this embodiment are made with the printing controller 20. The printing controller 20 is structured of, e.g. a microprocessor, ROMs (Read Only Memories), RAMs (Random Access Memories), input and output ports, a timer, and operation program. The printing controller 20 is connected to the exposure device 3, the fixing device 10, the writing sensor 15, the delivery sensor 16, the conveyance route switching portion 31, and the drive motor for driving rotations of the respective rollers in the photosensitive drums 5, the charge rollers 6, the developing rollers 41, the hopping roller 14, the first conveyance roller 11, and the second conveyance roller 12, the drive roller 8, and the heating roller 101, and integrally controls the printer 100 upon control of those components.

Next, the toner used in the printer 100 described above are described. The toner of the respective colors according to this embodiment are contained in the toner cartridge not illustrated, and are used for developing the toner images after supplied to the developing devices 4.

As the toner applicable to the invention, exemplified are a kneaded pulverized toner obtained from pulverization and classification of a kneaded material after melting and kneading, e.g. binder resin, mold releasing agent, colorant, charge control agent, and wax, and a polymerized toner obtained from polymerization with oil droplets regulated with dispersant to a prescribed size by a homogenizer or the like from a monomer as a binder resin raw material in which, e.g., polymerization initiator, colorant, charge control agent, wax are dispersed in an aqueous solvent.

For example, when using a kneaded pulverized toner made of binder resin, colorant, charge control agent, mold releasing agent, and external additive as a toner for the invention, synthetic resins used generally as resins for toner can be used as the binder resin, and such as polyester based resin, styrene-acryl based resin, epoxy based resin, and styrene-butadiene based resin can be used for the binder resin.

As the mold releasing agent, exemplified are publicly known materials, such as low molecular weight polyethylene, low molecular weight polypropylene, olefin copolymer, aliphatic hydrocarbon-based wax, e.g. microcrystalline wax, paraffin wax, and Fischer-Tropsch wax, aliphatic hydrocarbon-based wax oxide, e.g. polyethylene wax oxide and their block copolymer, wax group having a main component of aliphatic ester, e.g. carnauba wax, and montanic acid ester wax, and materials in which fatty acid ester group is partly or entirely deoxidized, e.g. deoxidized carnauba wax.

As the colorant, conventional black toner, dyes and pigments used for colorants of color toner can be used, and exemplified are such as carbon black, ferric oxide, phthalocyanine blue, permanent brown FG, brilliant fast scarlet, pigment green B, rhodamine B base, solvent red 49, solvent red 146, pigment blue 15:3, solvent blue 35, quinacridone, carmine 6B, and disazo yellow.

No colorant is added to the clear toner (CL), so that the clear toner has higher transparency in comparison with such as yellow toner (Y), magenta toner (M), cyan toner (C), and black toner (K). As a fluorescent colorant added instead of the colorant, any of organic fluorescent colorants, e.g. 9,10-dianilinoanthracene, and 2-hydroxy-1-naphthaldehyde, and inorganic fluorescent colorants, e.g. zinc oxide, and zinc sulfide. In this embodiment, there is no limitation to selection of fluorescent colorants as far as the colorant is recognizable as emitting light in an inherent color when an ultraviolet ray radiates the toner image developed in use of a toner including a fluorescent colorant, and as far as the toner image under visible light becomes non-visible likewise so-called "white solid" image.

To the toner, added accordingly are charge control agent, conductive adjusting agent, extender pigment, reinforcing filler such as fabric materials, additive such as antioxidant, aging inhibitor, flowability improver, and inorganic fine particles for improving environmental stability, charge stability, developing property, flowing property, and preserving property.

Toner matrix particles can be obtained by melting and kneading, after mixing the binder resin, the mold releasing agent, the charge control agent, the colorant, and the fluorescent colorants with, e.g. a Henschel mixer, the mixed material with a twin-screw extruder, by pulverizing the material with a collision plate type pulverizer after cooled down and roughly ground with a cutter mill, and by classifying the material using an air classifier. Inorganic fine particles, e.g. hydrophobic silica are added as external additives to the toner matrix particles, and through stirring the material for a prescribed time, targeted clear toner (CL), yellow toner (Y), magenta toner (M), cyan toner (C), and black toner (K), as well as white toner (W) described below, can be obtained.

Next, operation of the printer 100 according to the embodiment is described. First, operation when the printer 100 forms images is described.

Where receiving a printing instruction from an external terminal not illustrated connected via a network, e.g. LAN (local area network) or USB (universal serial bus), the printing controller 20 performs processings of page data contained in the printing command, conveyance control of the recording medium 17, charge control, exposure control, development control, primary transfer control, secondary transfer control, and fixing control to make printing on the recording medium as the result.

More specifically, upon reception of the printing instruction from the external terminal not illustrated, the printing controller 20 controls heating of the fixing device 10 to be at a usable temperature by controlling the heating device mounted inside the heating roller 101 in the fixing device 10. When the fixing device 10 reaches the usable temperature, the printing controller 20 starts rotation of the photosensitive drum 5 by controlling the drive motor not illustrated, thereby accelerating the line speed of the drum until reaching the conveyance speed of the recording medium 17 during printing operation.

The printing controller 20 at the same time as the above operation, controls the drive motor not illustrated to rotate the drive roller 8, thereby beginning the drive of the transfer belt 7, and thereby accelerating the line speed of the transfer belt 7 until reaching the conveyance speed of the recording medium 17 during printing operation.

At a timing that the photosensitive drum 5 begins rotation, the printing controller 20 applies a charge voltage to the charge roller 2 by controlling the high voltage power supply not illustrated, thereby charging the surface of the photosensitive drum 5 at, e.g. −600 Volts. At a timing that a portion of the surface of the photosensitive drum 5 charged at −600 Volt passes a developing area of the developing device 4 according to the rotation, the printing controller 20 controls the developing device 4 in a developable state. In a case of a contact development method using the developing roller likewise in this embodiment, the developing device 4 enters the developable state by applying a voltage having the same polarity as the toner from the high voltage power supply not illustrated to the developing roller attached with the toner negatively charged.

The printing controller 20 analyzes page date contained in the printing command transmitted from the external terminal not illustrated into respective colors of clear, yellow, magenta, cyan, and black, and converts the analyzed data into the image data writable as electrostatic latent images at the exposure device 3.

The exposure device 3 makes the surface of the photosensitive drum 5 charged at −600 Volts subject to light attenuation to around −50 Volts with respect to the core metal by radiating spot light of, e.g., 600 dpi to the surface portions of the photosensitive drum 5 at which the toner images are expected, thereby forming electrostatic latent images.

The surface portions of the photosensitive drum 5 at which the exposure device 3 forms the electrostatic latent images are moved to the position of the developing device 4 according to the rotation of the drum itself, and toner images are developed by attaching toner negatively charged to the portions at which the surface potential absolute value is lowered according to Coulomb force.

The surface portions of the photosensitive drum 5 at which the toner images are formed are moved to a position for primary transfer according to the rotation of the drum itself. A transfer voltage having the opposite polarity to the charge voltage of the toner is applied from the high voltage power supply not illustrated according to the control of the printing controller 20 to the primary transfer roller 6 disposed in contact with the photosensitive drum 5 with pressure via the transfer belt 7, and the toner attached to the surface portions of the photosensitive drum 5 is primarily transferred to the transfer belt 7 upon receiving Coulomb force from the positive voltage applied to the primary transfer roller 6.

Those steps are executed sequentially for development using toner of clear, yellow, magenta, cyan, and black, thereby overlaying the toner images. The portion at which the toner images are transferred is moved to a position of the nipping portion N serving as the secondary transfer position formed from the secondary transfer roller 21 and the secondary transfer backup roller 22 via the transfer belt 7.

The printing controller 20 controls the drive motor not illustrated so that the toner images on the transfer belt 7 are transferred to a desired transfer portion on the recording medium 17 at the secondary transfer portion, and rotates the hopping roller 14 to feed the recording medium 17 sheet by sheet separately. The recording medium 17 fed by the hopping roller 14 is conveyed to the second conveyance roller 12 via the route S1 from the first conveyance roller 11 rotating according to drive of the drive motor not illustrated based on the control from the printing controller 20.

The writing sensor 15 arranged on the downstream side of the second conveyance roller 12 on the route S1 outputs the detection result to the printing controller 20 when detecting the front end of the recording medium 17. The printing controller 20 receiving the input from the writing sensor 15 controls so that the toner images are properly transferred at the nipping portion N at a desired portion on the recording medium 17 by adjusting the conveyance speed of the recording medium 17, or namely the rotation speed of the second conveyance roller 12, upon measuring a timing that the writing sensor 15 detects the front end of the recording medium 17, and upon comparing a distance from the toner images on the transfer belt 7 to the nipping portion N as the secondary transfer portion with a distance from the writing sensor 15 to the secondary transfer portion.

The transfer voltage having the opposite polarity to the charge voltage of the toner from the high voltage power supply not illustrated is applied to the secondary conveyance roller 21 structuring the nipping portion N according to the control form the printing controller 20. The secondary transfer backup roller 22 is coupled to the ground level. The toner images on the transfer belt 7 are secondarily transferred onto the recording medium 17 at the timing passing the nipping portion N.

The recording medium 17 to which the toner images are secondarily transferred at the nipping portion N is conveyed to the fixing device 10 arranged at the end point of the route S3, and the toner is applied with heat and pressure when the recording medium 17 passes between the heating roller 101 maintained at the prescribed fixing temperature and the backup roller 102. The toner is melt, the toner image is fixed.

Where the recording medium 17 passes through the delivery sensor 16, where the conveyance route of the recording medium 17 is switched to the route S4 according to the conveyance route switching portion 31, and where the recording medium 17 is delivered out of the apparatus body according to the rotation of the delivery roller 13 provided on the route S4, the printing controller 20 stops rotation operation of the respective rollers, charge control of the charge roller 2, and developing control at the developing device 4, and ends printing operation. The printing controller 20 executes processing of operation stop of the printer 100 in a case where the passing timing of the recording medium 17 at the delivery sensor 16 is extraordinary. The printing controller 20 executes processing of operation stop of the printer 100 in substantially the same way in a case where the passing timing of the recording medium 17 at the writing sensor 15 is also extraordinary.

Figure 2:
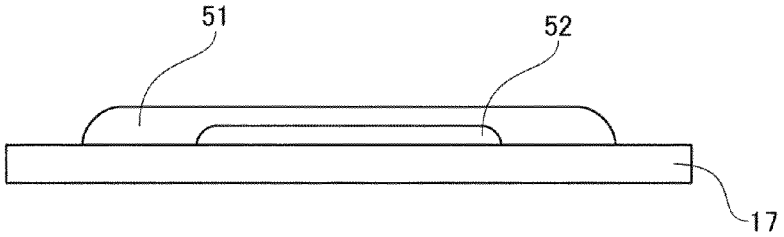
FIG. 2 is a process cross-sectional view showing a transfer sequence of toner images on a recording medium according to the first embodiment.

Next, image forming operation using the clear toner (CL) according to this embodiment is described. In image formation using the clear toner (CL) according to the embodiment, a clear toner layer 51 as shown in FIG. 2 is transferred to a portion to draw attention by making the image glossy as a topmost layer over a color toner layer or layers 52, and is then fixed, so that a highly gloss region can be formed in comparison with a portion where no clear toner layer exists.

More specifically, in FIG. 1, the printing controller 20 sequentially forms the toner images of yellow toner (Y), magenta toner (M), cyan toner (C), and black toner (K) when necessary, after image formation using the clear toner (CL). When those toner images are overlapped and transferred onto the transfer belt 7, the toner image using the clear toner CL is the bottommost layer at that stage. When the toner images on the transfer belt 7 are secondarily transferred at the nipping portion N onto the recording medium 17, the transfer sequence of the images is reversed, and the toner image using the clear toner (CL) is positioned at the topmost layer. The recording medium 17 to which the toner images are transferred is conveyed to the fixing device 10 via the route S3. The recording medium 17 onto which the toner images are fixed at the fixing device 10 is delivered out of the apparatus body according to the rotation of the delivery roller 13 via the route S4. Thus, the portion at which the toner image using the clear toner (CL) is overlapped can have a higher glossing property than a portion of no overlapping. Such representation is realized, because the clear toner according to the embodiment is transparent, and because the glossing property is higher than that of other toner.

On the other hand, where toner containing a fluorescent colorant emitting light upon radiation of the ultraviolet ray is used for the clear toner (CL), in utilizing this feature, a secrecy representation may be possible which is not so much noticeable under visible light but visible under the ultraviolet ray. In a case that the representation with the higher glossing property as described above is made, however, the toner image using the clear toner (CL) becomes the topmost layer under the visible light, so that the image is readily visible, resulting in printing of low secrecy.

Figure 3:
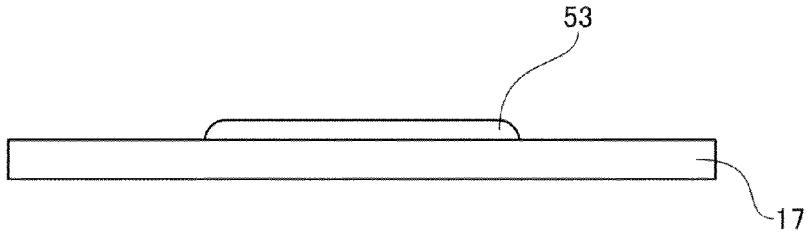
FIG. 3 is a process cross-sectional view showing the transfer sequence of the toner images on the recording medium according to the first embodiment.
Figure 4:
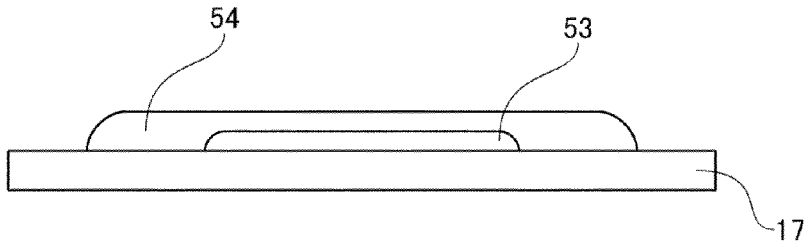
FIG. 4 is a process cross-sectional view showing the transfer sequence of the toner images on the recording medium according to the first embodiment.

As a method for making such a representation, as shown in FIG. 3, first, a toner image using a clear toner layer 53 is formed, and this is transferred to the recording medium 17 one time. After fixing the clear toner layer 53 to the recording medium 17, the toner images of yellow toner (Y), magenta toner (M), cyan toner (C), and black toner (K) are sequentially formed as image formation of the second time as to cover the toner image using the clear toner (CL). As shown in FIG. 4, according to the transfer operation of the second time and the fixing operation, the portion of the toner image using the clear toner (CL), or namely, the clear toner layer 53 is shield and hardly seen under the color toner layer 54. In a case where the recording medium has a thin thickness or has higher transparency, the toner image using the clear toner (CL) or namely the clear toner layer 53 emits light by radiating the ultraviolet ray from the back side, thereby making the toner image recognizable.

More specifically, in FIG. 1, the printing controller 20 first forms a toner image using the clear toner (CL) and primarily transfers the image to the transfer belt 7. The toner image portion using the clear toner (CL) transferred onto the transfer belt 7 is secondarily transferred onto the recording medium 17 at the nipping portion N, and is conveyed to the fixing device 10 via the route S3. The conveyance route of the recording medium 17 is switched to the route S5 by the conveyance route switching portion 31 based on the control of the printing controller 20, and the recording medium 17 is conveyed via the route S5 in a state that the transfer side of the toner image is down. The recording medium 17 is conveyed again to the nipping portion N in a manner that the transfer side of the toner image is up as conveyed to the first conveyance roller 11, the route S1, and the second conveyance roller 12, and is subject to transfer of the toner image of the second time. The recording medium 17 that finished the transfer of the toner image of the second time is delivered to the exterior of the apparatus body according to rotation of the delivery roller 13 upon conveyed through the route S3, the fixing device 10, and the route S4.

As described above, according to the first embodiment, with the sole image forming apparatus in use of the clear toner (CL), both of representations, the representation making necessary toner image portions gloss, and the representation making unnoticeable under visible light but visible under ultraviolet light, can be realized.

Second Embodiment

The structure of a printer 200 as an image forming apparatus according to the second embodiment is substantially the same as that in the printer 100 according to the first embodiment. Accordingly, in the following description, the same components and parts as those in the printer 100 according to the first embodiment are assigned with the same reference numbers, while omitting their descriptions, and only different portions are described.

Figure 5:
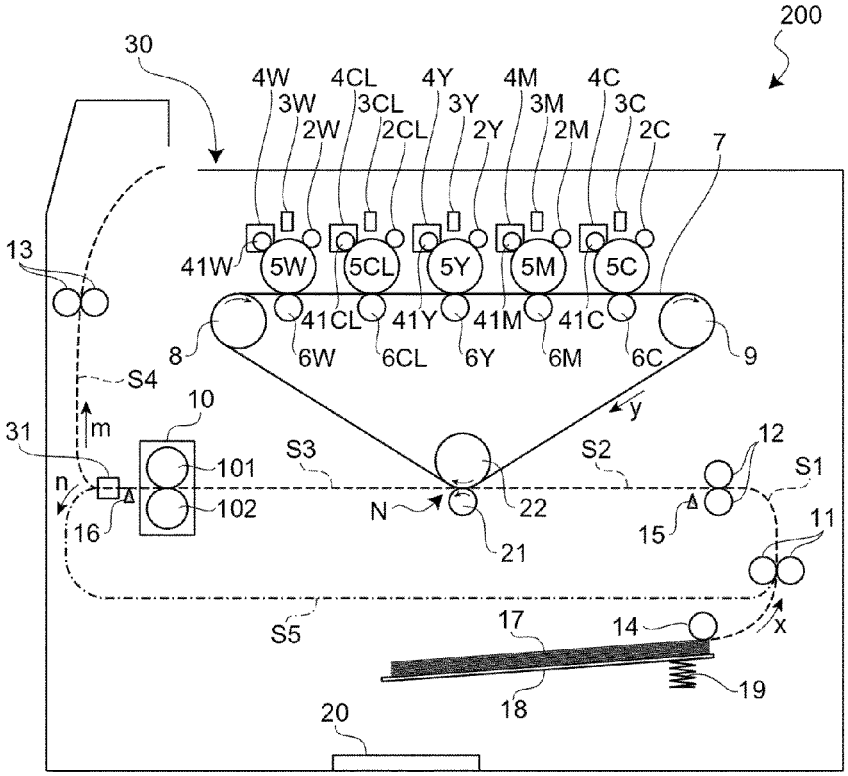
FIG. 5 is a schematic view of an essential structure of a printer as an image forming apparatus according to a second embodiment of the invention.

FIG. 5 shows an essential structural diagram showing the printer 200 according to the second embodiment. The printer 200, as different from the printer 100 in the first embodiment, does not use black toner (K) but makes color representation of black in the toner image from a process black mixed with yellow toner (Y), magenta toner (M), and cyan toner (C). The printer 200 includes a photosensitive drum 5W forming toner images using white toner (W), a charge roller 2W, an exposure device 3W, and a developing device 4W having a developing roller 41W. Where high secrecy printing under visible light is made as described in the first embodiment, toner image printing is done with two types of toner, the white toner (W) and the clear toner (CL).

As shown in FIG. 5, the overlapping sequence of the toner in the printer 200 is white toner (W), clear toner (CL), yellow toner (Y), magenta toner (M), and cyan toner (C) from the bottommost layer side on the transfer belt 7. Accordingly, on the recording medium 17, this overlapping sequence is reversed, so that the sequence on the recording medium 17 is cyan toner (C), magenta toner (M), yellow toner (Y), clear toner (CL), and white toner (W) from the bottommost layer side.

It is to be noted that the printer 200, in substantially the same way as the printer 100, can transfer and fix the toner image of the second time to the recording medium on which the toner image is already transferred and fixed as the first time, and the printer 200 can change the overlapping sequence on the recording medium 17 to some extent by controlling the colors to be printed at the first and second times, respectively.

In operation of the printer 200 according to the second embodiment, descriptions of the same operation in the printer 200 as that in the printer 100 according to the first embodiment are omitted, and only different portions are described.

First, in a case of a representation making necessary portions glossy using the clear toner (CL), the operation can be done in substantially the same manner as that in the first embodiment, but in the printer 200 according to the second embodiment, a point that the process black made from a mixture of yellow toner (Y), magenta toner (M), and cyan toner (C) is used for black color representation of the toner images, is different from the first embodiment.

Figure 6:
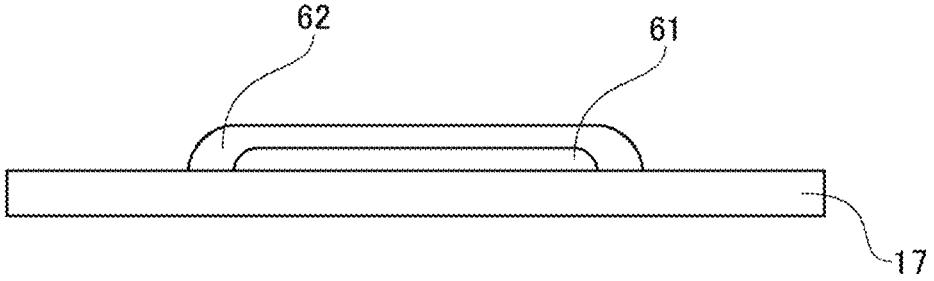
FIG. 6 is a process cross-sectional view showing a transfer sequence of toner images on a recording medium according to the second embodiment.

In a case where a representation is made non-visible under visible light but visible under the ultraviolet ray, the printing controller 20 forms toner images using the clear toner (CL) after forming toner image using the white toner (W), and primarily transfers the toner images onto the transfer belt 7. The toner image portions using the white toner (W) and the toner image portions using the clear toner (CL), transferred onto the transfer belt 7, are secondarily transferred to the recording medium 17 at the nipping portion N, and are conveyed to the fixing device 10 via the route S3. As shown in FIG. 6, a clear toner layer 61 of the clear toner (CL) is formed as the bottommost layer on the recording medium 17, while a white toner layer 62 of the white toner (W) is overlapped on the clear toner layer 61, and the, toner images of the second time are formed in a state that the clear toner layer 61 is shielded. The conveyance route of the recording medium 17 is switched to the route S5 by the conveyance route switching portion 31 based on the control of the printing controller 20, and the recording medium 17 is conveyed via the route S5 in a state that the transfer side of the toner images is down. The recording medium 17 is conveyed again to the nipping portion N in a manner that the transfer side of the toner image is up as conveyed to the first conveyance roller 11, the route S1, and the second conveyance roller 12, and is subject to transfer of the toner image of the second time. The recording medium 17 that finished the transfer of the toner image of the second time is delivered to the exterior of the apparatus body according to rotation of the delivery roller 13 upon conveyed through the route S3, the fixing device 10, and the route S4.

Figure 7:
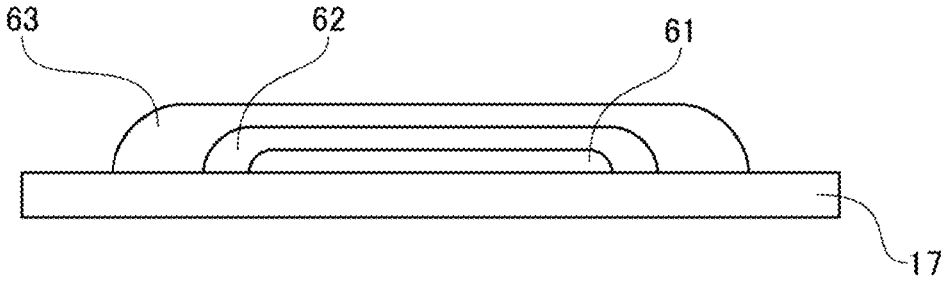
FIG. 7 is a process cross-sectional view showing the transfer sequence of the toner images on the recording medium according to the second embodiment.

As shown in FIG. 7, because printing is made in a way that the white toner layer 62 of the white toner (W) overlaps the clear toner layer 61 of the clear toner (CL) and that a multicolor layer 63 of the color toner made of the cyan toner (C), the magenta toner (M), and the yellow toner (Y) overlap the white toner layer 62 of the white toner (W), the toner images using the clear toner (CL) may not be recognized at a glance. Even where viewed from the back side of the printing surface, or even where a recording medium having high transparency is used, it is hard to find out the printing portion of the clear toner (CL) in a united body with the white toner (W). Such toner images, however, can be readily recognized by radiating the ultraviolet ray from the back side of the printing surface to make the toner images using the clear toner (CL) emit light.

As described above, according to the second embodiment, the toner image portion using the clear toner (CL) is shielded with the toner image using the white toner (W), and the color toner are further printed in an overlapping manner on the toner images, so that the toner images using the clear toner are completely made invisible from the printing surface. Furthermore, by radiation of the ultraviolet ray from the back side of the printing surface, the toner image portion using the clear toner (CL) emits light, thereby making the portion visible, as well as providing a higher secrecy to the portion. According to the embodiment, using the clear toner (CL) and the white toner (W), the toner images can have the higher secrecy as well as make themselves readily visible from light emission when the ultraviolet ray is radiated.

Although in the descriptions of the embodiments the printer is used as the image forming apparatus, the invention is not limited to this description, and is applicable to, e.g. MPFs, facsimile machines, and photocopiers as far as any apparatus having a structure that developers are developed with electric field and transferred using photosensitive drums. In this invention, the color number of the toner is not specially restricted, and this invention is applicable to any multicolor image forming apparatus in substantially the same way. Although in the description of the embodiments, the image forming apparatus of the intermediate transfer method is described, this invention is applicable to image forming apparatuses of a direct transfer method by adjusting the transfer sequence of the toner. It is to be noted that in the description of the embodiments, the feature that the toner overlapping sequence is changed from the feeding rule of the recording medium, this invention is not limited to this structure, and can be made by changing the sequence of the image forming units such as photosensitive drums and the developing devices. Although in the description of the embodiments, the feature using the toner for improving visibility by radiating the ultraviolet ray is described, other toner (e.g., lanthanide based materials) improving visibility by radiating an infrared ray may be used instead.

While only selected embodiments have been chosen to illustrate this invention, it will be apparent to those skilled in the art from this disclosure that various changes and modifications can be made herein without departing from the scope of the invention as defined in the appended claims. Furthermore, the foregoing descriptions of the embodiments according to this invention are provided for illustration only, and not for the purpose of limiting the invention as defined by the appended claims and their equivalents.

What is claimed is:

1. An image forming apparatus comprising:

a plurality of image forming units for forming multicolor images on an image carrier by overlapping, on a medium, first and second developer images developed using developers;

a changeover unit changing a layer overlapping sequence of the first and second developer images on the medium;

a transfer unit for transferring the first and second developer images to the medium; and a fixing unit for fixing the first and second developer images on the medium, wherein the developers include a developer emitting light according to radiation of non-visible light, wherein the changeover unit changes the layer overlapping sequence of the first and second developer images using the developer emitting the light according to radiation of the non-visible light, wherein the developer emitting light according to the radiation of the non-visible light has high transparency, wherein the image forming apparatus is configured to set an image to a high gloss mode or a high secrecy mode, wherein, when an image is set to the high gloss mode, the changeover unit changes the layer overlapping sequence of the developer images so that the second developer image is overlapped on the first developer image on the medium, wherein, when an image is set to the high secrecy mode, the changeover unit changes the layer overlapping sequence of the developer images so that the first developer image is overlapped on the second developer image on the medium, and wherein the transferring and fixing are performed once when the image is set to the high gloss mode or twice when the image is set to the high secrecy mode.

2. The image forming apparatus according to claim 1, wherein the changeover unit changes the layer overlapping sequence so that the developer image using the developer emitting light according to the radiation of the non-visible light is overlapped immediately on the medium.

3. The image forming apparatus according to claim 1, wherein the developer image overlapped immediately on the developer image developed with the developer emitting light according to the radiation of the non-visible light is developed with a developer having high brightness.

4. The image forming apparatus according to claim 1, wherein the changeover unit changes the layer overlapping sequence so that the developer image using the developer emitting light according to radiation of the non-visible light is overlapped as the topmost layer among the developer images sequentially overlapped on the medium.

5. The image forming apparatus according to claim 1, wherein the non-visible light is either of an ultraviolet ray and an infrared ray.

6. The image forming apparatus according to claim 1, wherein the developer image using the developer emitting light according to the radiation of the non-visible light is transferred to the medium by the transfer unit and fixed to the medium by the fixing unit, and the developer image using another developer is thereafter transferred to the medium by the transfer unit and fixed to the medium by the fixing unit.

7. The image forming apparatus according to claim 6, wherein the developer emitting light according to the radiation of the non-visible light is a clear toner.

8. The image forming apparatus according to claim 7, wherein the other developer is any one of yellow toner, magenta toner, cyan toner, and white toner or combination thereof.

9. The image forming apparatus according to claim 8, wherein a developer image using the clear toner and a developer image using the white toner are transferred and fixed to the medium, and developer images using any one of yellow toner, magenta toner, and cyan toner or combination thereof are transferred thereafter and fixed to the medium.

10. An image forming method comprising the steps of:

forming a plurality of images formed of multicolor images on an image carrier by overlapping, on a medium, first and second developer images developed using developers;

changing a layer overlapping sequence of the first and second developer images on the medium;

transferring the first and second developer images to the medium; and fixing the first and second developer images on the medium, wherein the developers include a developer transmitting light according to radiation of visible light, wherein during the changing step, the layer overlapping sequence of the developer images using the developer transmitting the light according to radiation of the visible light is changed, and wherein the developer through which the visible light transmits is a developer emitting light according to the radiation of non-visible light wherein the changing of the layer overlapping sequence comprises:

when an image is set to be in a high gloss mode, selecting the layer overlapping sequence of the developer images so that the second developer image is overlapped on the first developer image on the medium, when an image is set to be in a high secrecy mode, selecting the layer overlapping sequence of the developer images so that the first developer image is overlapped on the second developer image on the medium, and wherein the transferring and fixing are performed once when the image is set to be in the high gloss mode or twice when the image is set to be in the high secrecy mode.

11. The image forming method according to claim 10, wherein during the changing step, the layer overlapping sequence is changed so that the developer image using the developer emitting light according to the radiation of the non-visible light is overlapped immediately on the medium.

12. The image forming method according to claim 10, wherein the developer emitting light according to the radiation of the non-visible light has high transparency.

13. The image forming method according to claim 10, wherein the developer image overlapped immediately on the developer image developed with the developer emitting light according to the radiation of the non-visible light is developed with a developer having high brightness.

14. The image forming method according to claim 10, wherein during the changing step, the layer overlapping sequence is changed so that the developer image using the developer emitting light according to radiation of the non-visible light is overlapped as the topmost layer among the developer images sequentially overlapped on the medium.

15. The image forming method according to claim 10, wherein the non-visible light is either of an ultraviolet ray and an infrared ray.

16. An image forming apparatus comprising:

a first image forming unit for forming a first developer image using a first developer;

a second image forming unit for forming a second developer image using a second developer emitting light according to the radiation of the non-visible light;

a transfer unit for transferring the first developer image using the first developer and the second developer image using the second developer to a medium; and a control unit for controlling the first image forming unit, the second image forming unit, and the transfer unit so that the second developer image is formed on the medium and the first developer image is overlapped on the second developer image formed on the medium, wherein the second developer has a higher transparency than the first developer; and a fixing unit for fixing the first developer image and the second developer image transferred to the medium, wherein the image forming apparatus is configured to have a first mode and a second mode, wherein, when the first mode is selected, the control unit: 1) forms the second developer image with the second developer using the second image forming unit, 2) forms the first developer image, on the second developer image, with the first developer using the first image forming unit, 3) transfers the second and first developer images to the medium, and 4) fixes the second and first developer images transferred to the medium using the fixing unit, and wherein, when the second mode is selected, the control unit: 1) forms the second developer image with the second developer using the second image forming unit, 2) transfers the second developer image to the medium, 3) fixes the second developer image transferred to the medium using the fixing unit, 4) forms the first developer image with the first developer using the first image forming unit, 5) transfers the first developer image to the medium fixed the second developer image, and 6)

fixes the first developer image transferred to the medium using the fixing unit.

17. The image forming apparatus according to claim 16, wherein the non-visible light is either of an ultraviolet ray or an infrared ray.

18. The image forming apparatus according to claim 16, wherein the apparatus further comprises:

wherein the second developer image using the second developer emitting light according to the radiation of the non-visible light is transferred to the medium by the transfer unit and fixed to the medium by the fixing unit, and the first developer image using the first developer is thereafter transferred to the medium by the transfer unit and fixed to the medium by the fixing unit.

19. The image forming apparatus according to claim 16, wherein the second developer emitting light according to the radiation of the non-visible light is a clear toner.

20. The image forming apparatus according to claim 16, wherein the first developer is any one of yellow toner, magenta toner, cyan toner, and white toner or a combination thereof.

21. The image forming apparatus according to claim 16, wherein the apparatus further comprises:

a third image forming unit for forming a third developer image using a third developer, wherein the transfer unit transfers the first developer image, the second developer image, and the third developer image to the medium, the fixing unit is configured to fix the third developer image transferred to the medium, and wherein the second developer image using the second developer emitting light according to the radiation of the non-visible light and the third developer image using the third developer are transferred to the medium by the transfer unit and fixed to the medium by the fixing unit, and the first developer image using the first developer is thereafter transferred to the medium by the transfer unit and fixed to the medium by the fixing unit.

22. The image forming apparatus according to claim 21, wherein the second developer is a clear toner, the third developer is a white toner, and the first developer is any one of yellow toner, magenta toner, and cyan toner or a combination thereof.

23. The image forming apparatus according to claim 22, wherein the third developer image developed with the white toner is formed between the second developer image and the first developer image.

* * * * *